US007731067B2

(12) United States Patent
Schliemann

(10) Patent No.: US 7,731,067 B2
(45) Date of Patent: Jun. 8, 2010

(54) DEVICE FOR THE METERED DISPENSATION OF A MEDIUM

(76) Inventor: Eric Schliemann, Im Wornbühl 18, D-78256 Steisslingen (DE)

( * ) Notice: Subject to any disclaimer, the term of this patent is extended or adjusted under 35 U.S.C. 154(b) by 390 days.

(21) Appl. No.: 11/662,769

(22) PCT Filed: Sep. 14, 2005

(86) PCT No.: PCT/EP2005/009867

§ 371 (c)(1),
(2), (4) Date: Mar. 13, 2007

(87) PCT Pub. No.: WO2006/029833

PCT Pub. Date: Mar. 23, 2006

(65) Prior Publication Data

US 2007/0257063 A1 Nov. 8, 2007

(30) Foreign Application Priority Data

Sep. 14, 2004 (DE) ..... 10 2004 044 922
Aug. 19, 2005 (DE) ..... 10 2005 039 591
Sep. 9, 2005 (DE) ..... 10 2005 043 258

(51) Int. Cl.
*B65D 25/40* (2006.01)

(52) U.S. Cl. ..... 222/496; 222/212

(58) Field of Classification Search ..... 222/206, 222/207, 209, 212, 213, 215, 495–497; 239/573
See application file for complete search history.

(56) References Cited

U.S. PATENT DOCUMENTS 2,170,588 A * 8/1939 Douglas ..... 222/496
4,830,284 A 5/1989 Maerte
4,957,239 A 9/1990 Tempelman
5,158,215 A * 10/1992 Comment ..... 222/396
5,195,665 A * 3/1993 Lina ..... 222/496
5,558,258 A * 9/1996 Albini et al. ..... 222/496
5,657,930 A 8/1997 Battegazzore
5,842,616 A * 12/1998 Ruscitti et al. ..... 222/321.3
6,062,433 A * 5/2000 Fuchs ..... 222/153.13

* cited by examiner

*Primary Examiner*—Kevin P Shaver
*Assistant Examiner*—Daniel R Shearer
(74) *Attorney, Agent, or Firm*—Bachman & LaPointe, P.C.

(57) ABSTRACT

A device for the dosed output of a medium from a container through an opening in an upper housing part. A valve piston tip is associated with said opening for the closing thereof. A piston surface, which is pressed against a spring, is adjacent to the valve piston tip and is used as part of a valve piston, which is sealingly guided in a piston chamber in the upper part of the housing and forms a filling chamber which is connected to the container, between the upper part of the housing and the opening.

18 Claims, 4 Drawing Sheets

DEVICE FOR THE METERED DISPENSATION OF A MEDIUM

BACKGROUND OF THE INVENTION

The invention relates to a device for the metered dispensation of a medium from a container through an opening in an upper housing part, with the opening being assigned a valve piston tip in order to be closed off, and with the valve piston tip as part of a valve piston being adjoined by a piston face which is supported against a spring, is sealingly guided in a piston space in the upper housing part and forms a filling space between itself and the opening, which filling space is connected to the container.

Flexible bottles are known for example for eye droplets from which a droplet can be dispensed in the manner of a pipette into the eye. This is cumbersome and imprecise.

A spray device is for example known from EP 0 688 608 A1, in which spray device a dispensing opening is closed off by a valve piston tip. Said valve piston tip is part of a valve piston which is mounted so as to be supported against a spring. The medium can be introduced through the interior of the valve piston and through corresponding openings in the valve piston into a filling space, with a pressure being exerted on a piston face, which has the effect that the valve piston is moved counter to a spring, and the valve piston tip thereby opens the dispensing opening.

The present invention is based on the object of developing a device of the above stated type with which a medium can be metered in a simple and precise manner.

SUMMARY OF THE INVENTION

In order to achieve the object, it is provided on the one hand that a compressible element is arranged in the filling space.

Said compressible element can for example be an air ring or the like. It is important that the element can be compressed under pressure. The different possible embodiments of the compressible element, that is to say as an air ring, as a ball or the like, are to be encompassed by the present invention.

If the medium then flows, as a result of the pressure exerted on the container, through the duct and the recess in the valve piston into the filling space, then the element is compressed under the pressure of the filling space. The compressed medium subsequently pushes the valve piston open. At the same time, the element which is compressed by the medium can relax and the medium is pushed out of the filling space and out through the opening.

It is provided in a further exemplary embodiment that the connection between the container and the filling space is produced by means of a duct which bypasses the valve piston. The valve piston is opened only when the filling space is filled. This is provided by virtue of pressure being exerted on the container. If the pressure is removed, the opening is automatically closed.

In one preferred exemplary embodiment, however, the connection between the container and the filling space is produced by a duct and a recess in the valve piston itself. Here, it should be possible for said duct to be closed off, specifically at the moment at which the filling space is filled and the opening is opened. If the flow of the medium is now interrupted, the spring-mounted valve piston is returned to its initial position, thereby ejecting a precisely metered quantity out of the opening. For this purpose, the valve piston tip is also formed from two cones, with the first cone interacting with a metering space which is formed by the opening. The second cone serves to seal off the filling space from the external surroundings.

This permits a hydraulic, pressure-controlled opening of the opening for metering the medium. If the pressure is removed, the opening automatically closes, this taking place under the pressure of the spring. A microbiologically sealed metering system is provided in this way.

Also to be encompassed by the present invention is the possibility in any exemplary embodiment of using, instead of the springs, other force stores which can perform the function of a spring.

In order to simplify the use of the device for the metered dispensation of a medium in particular in the case of eye drops, a further embodiment of the device according to the invention provides arranging the container at approximately 90° with respect to the upper housing part or to the lower housing part. In the present case, the embodiment has been shown by way of example only on the basis of one of the exemplary embodiments of the device for the metered dispensation of a medium. The other exemplary embodiments of the device for the metered dispensation of a medium can of course also be used.

It is likewise entirely conceivable, depending on the field of application of the device, to provide an angle other than 90°. It is thus for example conceivable, with a corresponding arrangement of the duct, to provide a perpendicular arrangement of the container on the upper housing part. The different possibilities for the arrangement of the container on the upper housing part or the lower housing part are to be encompassed by the present invention.

BRIEF DESCRIPTION OF THE DRAWINGS

Further advantages, features and details of the invention can be gathered from the following description of preferred exemplary embodiments and on the basis of the drawing, in which.

DETAILED DESCRIPTION

Figure 1:
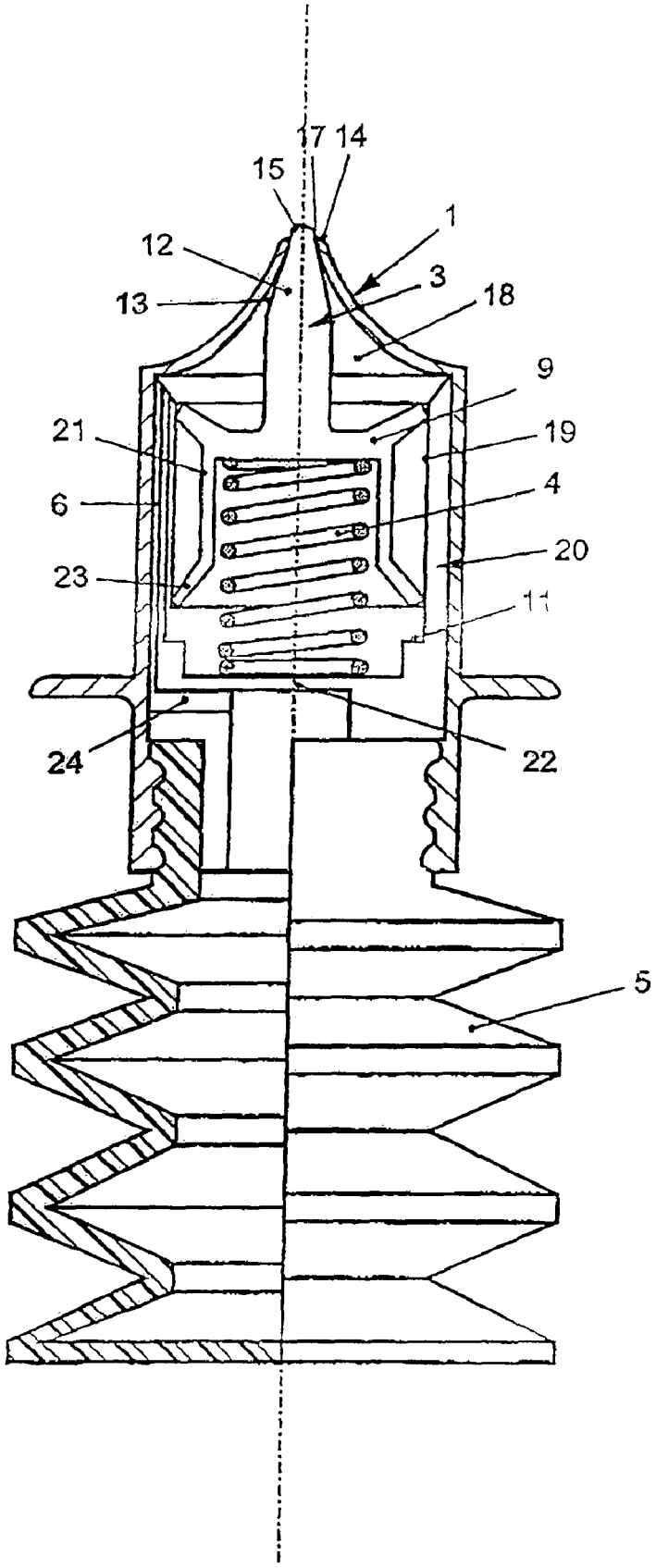
FIG. 1 shows a longitudinal section through a device according to the invention for the metered dispensation of a medium.

In FIG. 1, a device according to the invention for the metered dispensation of a medium has an upper housing part which is placed on a container 5. The medium to be dispensed, for example a liquid, is situated in said container 5.

Seated in the upper-housing part 1 is a valve piston 3 which, with a valve piston tip 12, closes off an opening 17. The valve piston 3 also has a piston face 9 which bears sealingly against an inner wall 19 of an insert 20 which is inserted into the upper housing part 1. The piston face 9 is adjoined by a sleeve section 21 which holds a spring 4 which is supported at the other side against an insert base 22. The sleeve section 21 ends with a projection 23 which likewise bears against the inner wall 19.

Formed above the piston face 9 is a filling space 18 which is connected by means of a duct 6 between the insert 20 and the upper part 1, and a duct section 24, to the interior of the container 5.

The present invention functions as follows:

When the compressible container 5 is actuated, the medium is pushed via the duct section 24 and the duct 6 into the filling space 18. The medium pushes against the piston face 9, so that the valve piston 3 moves downward counter to the pressure of the spring 4, and the filling space 18 is enlarged. The valve piston tip 12 thereby leaves the opening 17, with it being possible for the liquid flow and the dispensation volume to be controlled by means of the design of the valve piston tip and of the upper housing part 1 or of the opening 17. A valve piston stop 11 is also provided in the insert 20, which valve piston stop 11 in interaction with the projection 23 serves to likewise determine the opening cross section and therefore control the throughput of the medium.

Figure 2:
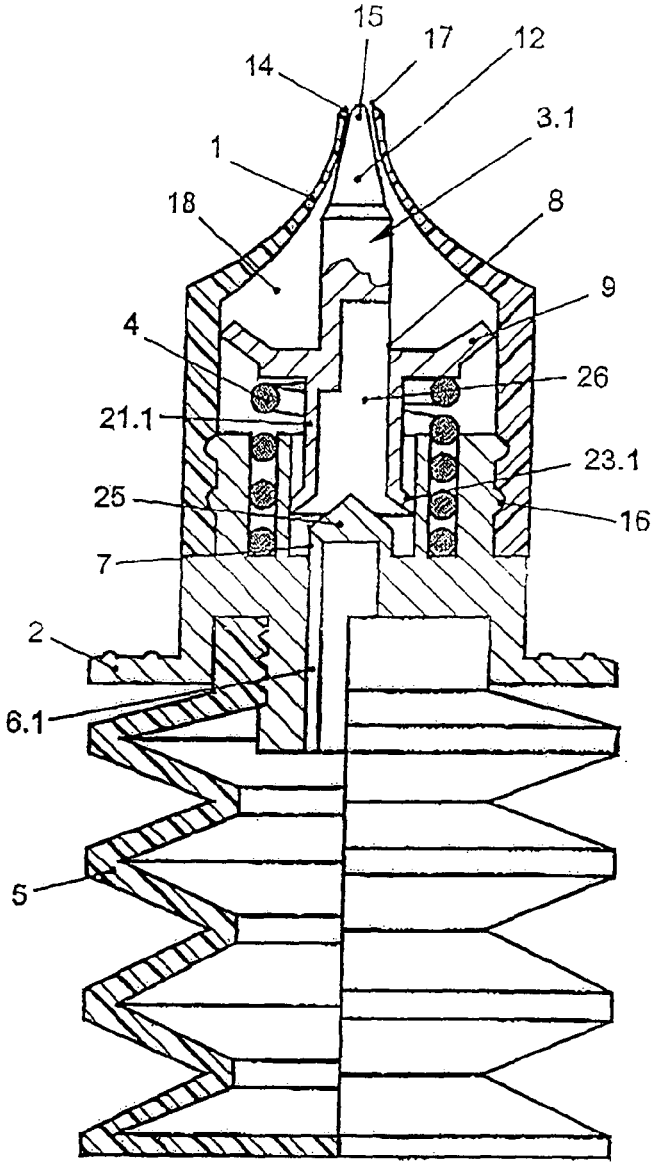
FIG. 2 shows a partially illustrated longitudinal section through a further exemplary embodiment of a device according to the invention for the metered dispensation of a medium.
Figure 4:
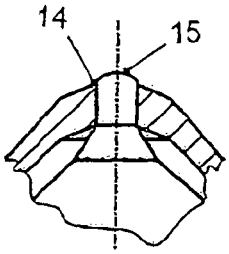
FIG. 4 is an enlarged illustration of a partial longitudinal section through an opening region of the device as per FIGS. 2 and 3, in the closed position.

In the exemplary embodiment of one device according to the invention for the metered dispensation of a medium as per FIG. 2, a lower housing part 2 is situated between the container 5 and the upper housing part 1. Provided on said lower housing part 2 are latch-in grooves 16 for connecting to the upper housing part 1, by means of which latch-in grooves 16 a complete metering system is formed, that is to say the upper housing part 1 and the lower housing part 2 are connected in a non-destructive manner.

Here, a valve piston 3.1 has the piston face 9 which is supported directly via the spring 4 against the lower housing part 2. A sleeve section 21.1 and a projection 23.1 also move in said spring 4. Said projection 23.1 however has a cross-sectional face which is considerably smaller than the piston face 9. In addition, said cross-sectional face interacts with a cone 25 which projects from the lower housing part 2. An outlet window 7 of a duct 6.1 can be seen on the cone 25, via which medium can exit through the outlet window 7 into the valve piston 3.1. The medium can flow through a recess 26 into the valve piston 3.1 and passes out through a further window 8 into the filling space 18.

This exemplary embodiment of the device according to the invention functions as follows:

If the bellows or the squeeze-bottle as a container 5 is acted on with the pressure of a finger, the displaced medium flows via the duct 6.1 through the window 7 into the recess 26 of the valve piston 3.1, and via the window 8 into the filling space 18. The spring-loaded large piston face 9 with a sealing lip is in system internal pressure against the small piston face of the projection 23.1, so that the hydraulic pressure which is exerted opens the valve counter to the spring force.

Figure 5:
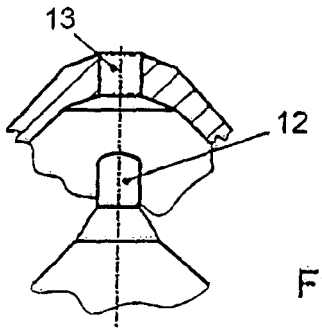
FIG. 5 is an enlarged illustration of a partial longitudinal section through the opening region as per FIG. 4, in the open position.

The return stroke of the piston face 9 is delimited by the abutment of the projection 23.1 against the cone 25, as a result of which the medium flow is also interrupted by the areal contact of the projection 23.1 against the cone 25 and the sealing lip action of the projection 23.1. As a result, the filling space 18 is returned to an unpressurized state, so that the spring force of the spring 4 can move the valve piston 3.1 into the initial position. Here, the stroke of the valve piston 3.1 moves medium to the opening 17, and the valve piston tip 12 pushes the droplet metered in a metering space 13 (see FIG. 5) out of the opening 17. As a result of a drip edge 14 or face 15 on the valve piston 3.1 and the upper housing part 1, the droplet releases from the system in the overhead position. As a result of the valve piston movement in the direction of the opening 17, the metered droplet is pushed out of the upper housing part 1 and, at the same time, the valve piston tip 12 closes off the system in a microbiologically sealed fashion by means of the spring 4.

The drip edge 14 or face 15 and the liquid output are defined by the geometry of the valve piston tip 12, which is formed from two cones, and by the opening 17 or the upper housing part 1.

Figure 3:
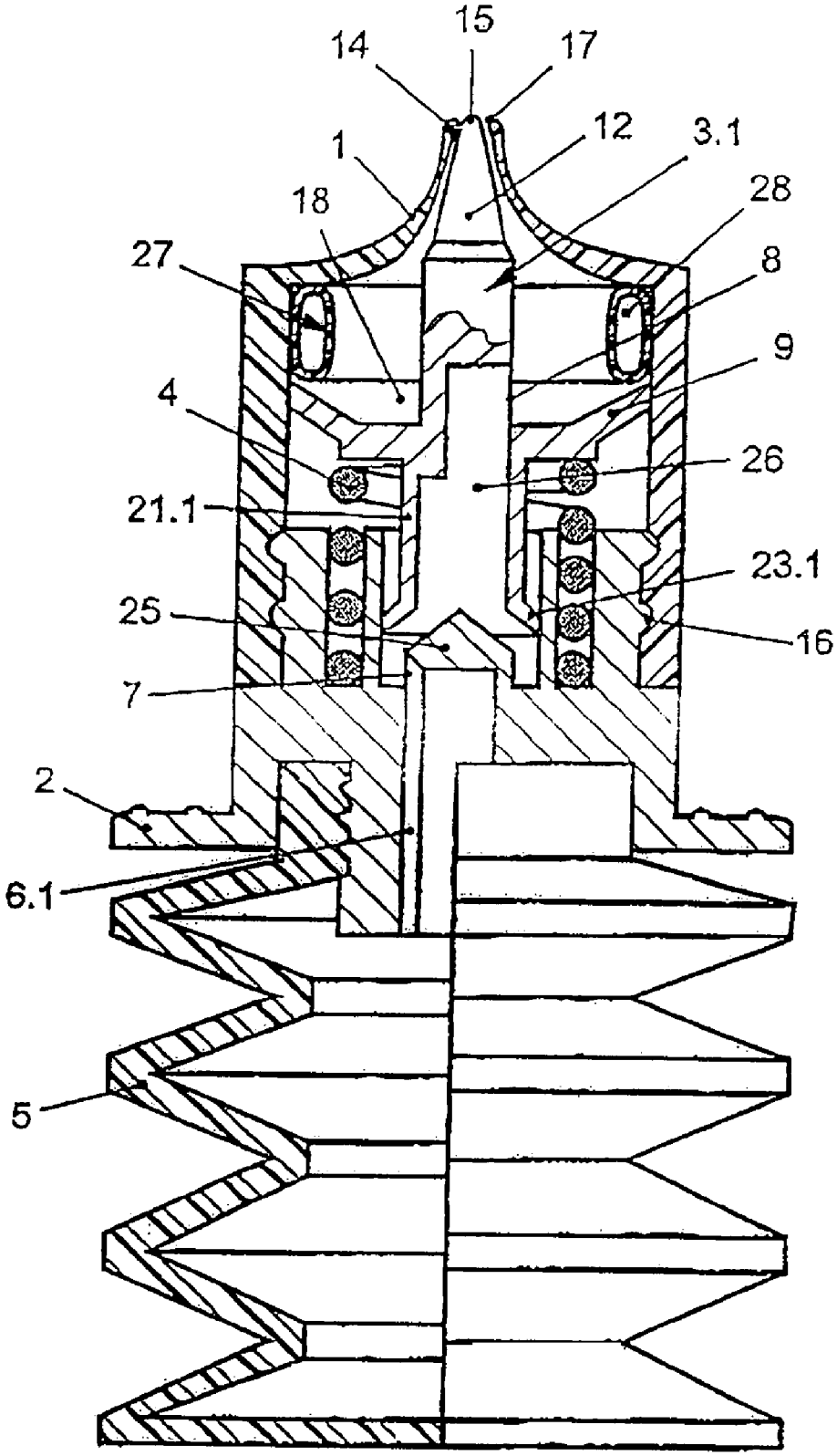
FIG. 3 shows a partially illustrated longitudinal section through a further exemplary embodiment of a device according to the invention for the metered dispensation of a medium.

A further embodiment of the device according to the invention for the metered dispensation of a medium is shown in FIG. 3. Here, an air ring 27 is arranged in the filling space 18 above the piston face 9 and around the valve piston 3.1. The air ring 27, as is apparent from the name, is filled in its interior with air, as a result of which it is compressible.

For the remaining description, reference is made for simplicity to the description regarding FIG. 2.

The functioning of said exemplary embodiment of the device according to the invention is likewise similar to the functioning of the previously described exemplary embodiment, for which reason reference is made thereto at this point. A new feature of this embodiment is however that the air ring 27 is compressed as the medium is forced into the filling space 18. After overcoming the force of the spring 4, the medium also pushes open the valve piston 3.1 which is under preload, so that the air ring 27 can relax and assists the dispensation of the medium out of the filling space 18. Since the filling space 18 is now unpressurized, the spring force of the spring 4 moves the valve piston 3.1 into its initial position. As a result of the stroke of the valve piston 3.1, the valve piston tip 12 pushes the droplet situated in the metering space 13 out of the opening 17. As a result of the drip edge 14 or face 15 on the valve piston 3.1 and the upper housing part 1, the droplet releases from the system in the overhead position. As a result of the valve piston movement in the direction of the opening 17, the metered droplet is pushed out of the upper housing part 1 and, at the same time, the valve piston tip 12 closes off the system in a microbiologically sealed fashion by means of the spring 4.

Figure 6:
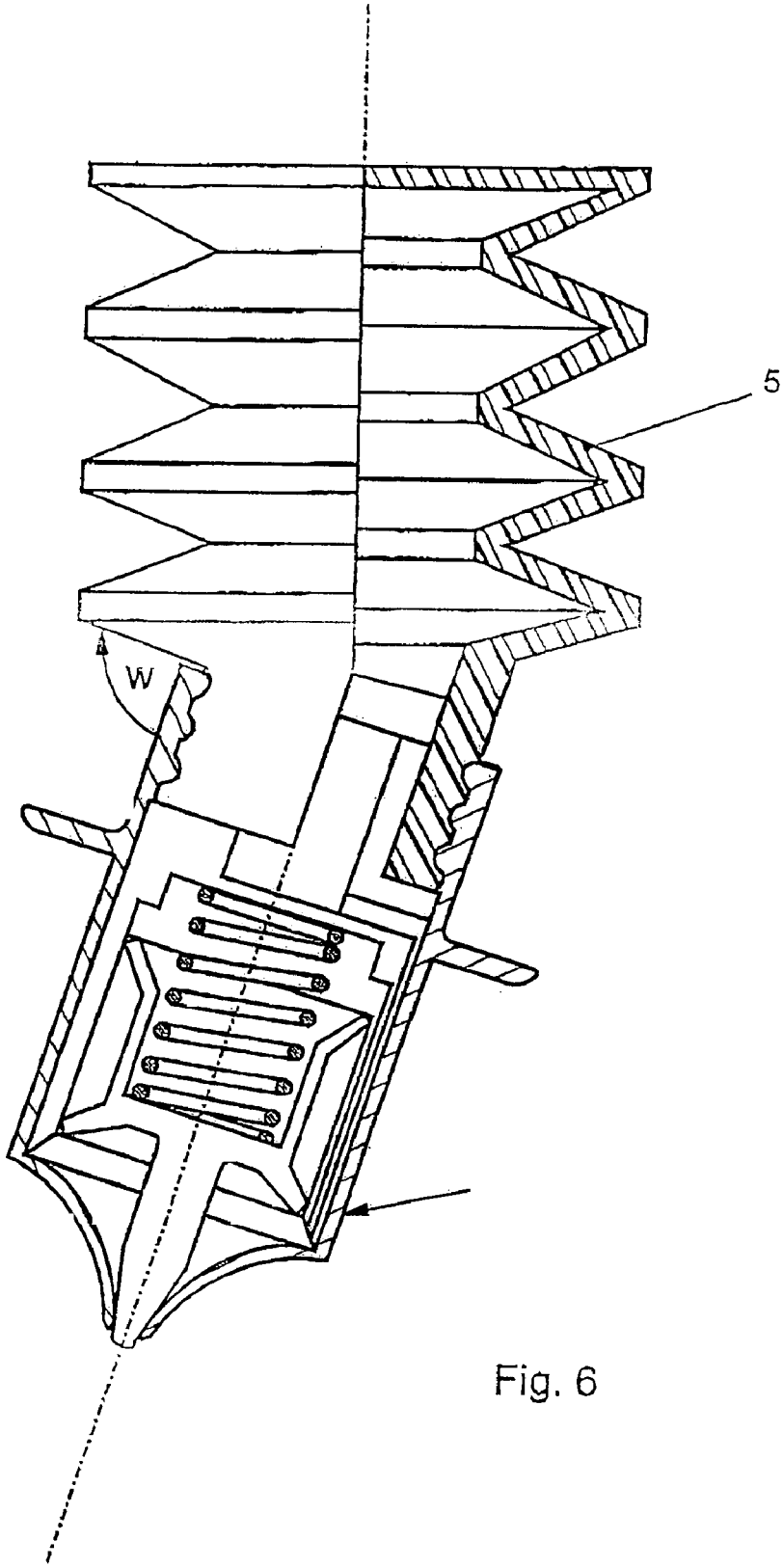
FIG. 6 shows a partially-illustrated longitudinal section through a device according to the invention for the metered dispensation of a medium as per FIG. 1.

In order to simplify the use of the device for the metered dispensation of a medium in particular in the case of eye drops, a further embodiment of the device according to the invention provides arranging the container 5 at an angle w of approximately 90° with respect to the upper housing part 1, as illustrated in FIG. 6. In the present case, the embodiment has been presented by way of example only on the basis of the device for the metered dispensation of a medium in FIG. 2. The exemplary embodiments of the device for the metered dispensation of a medium as per FIGS. 2 and 3 can of course also be used. In said case, the container 5 would then be arranged on the lower housing part 2.

Said embodiment does not provide any change in the mode of functioning, so that reference is made at this point to the above description.

The invention claimed is:

1. A container comprising:

a housing containing a medium to be dispensed, an opening and a dispensing device associated with the opening for the selective metered dispensing of the medium, the dispensing device comprises a valve piston having an upper surface and an opposed lower surface, a valve piston tip projecting from the upper surface for selectively closing off the opening, spring means shutting the lower surface for biasing the valve piston tip against the opening for closing off the same, passage means for communicating the medium from an interior space of the container to a filling space above the upper surface of the piston, and a compressible element comprising an air ring is arranged in the filling space, wherein the medium in the filling space acts on the piston in opposition to the spring means for moving the valve piston tip away from the opening.

2. A container according to claim 1, wherein the valve piston is sealingly guided in a piston space in the housing.

3. A container according to claim 1, wherein the passage means between the container and the filling space comprises a duct which bypasses the valve piston.

4. A container according to claim 1, wherein the passage means between the container and the filling space comprises a duct and a recess formed in the valve piston.

5. A container according to claim 4, wherein the duct is selectively closed off by the valve piston.

6. A container according to claim 1, wherein the upper surface of the valve piston has a larger area than that of the lower surface of the valve piston.

7. A container according to claim 4, wherein the upper surface of the valve piston has a larger area than that of the lower surface of the valve piston.

8. A container according to claim 7, wherein the valve piston closes off the duct with the lower surface of the valve piston.

9. A container according to claim 1, wherein the valve piston tip comprises two cones.

10. A container according to claim 1, wherein the valve piston is adjoined by a sleeve section.

11. A container according to claim 10, wherein the sleeve section encloses the spring means.

12. A container according to claim 11, wherein the spring means is movable in the sleeve section.

13. A container according to claim 12, wherein the spring means is supported against an insert base.

14. A container according to claim 1, wherein the spring means is supported against a lower housing part.

15. A container according to claim 14, wherein the lower housing part is arranged over latch-in grooves for connecting to an upper housing part.

16. A container according to claim 15, wherein a cone projects from the lower housing part, the cone being operatively connected to the valve piston.

17. A container according to claim 15, wherein the container is arranged at an angle (w) with respect to at least one of the upper housing part and lower housing part.

18. A container according to claim 17, wherein the angle (w) is approximately 90°.

* * * * *